United States Patent [19]

Shirai et al.

[11] Patent Number: 4,461,820

[45] Date of Patent: Jul. 24, 1984

[54] AMORPHOUS SILICON ELECTROPHOTOGRAPHIC IMAGE-FORMING MEMBER HAVING AN ALUMINUM OXIDE COATED SUBSTRATE

[75] Inventors: Shigeru Shirai, Yamato; Junichiro Kanbe; Tadaji Fukuda, both of Yokohama, all of Japan

[73] Assignee: Canon Kabushiki Kaisha, Tokyo, Japan

[21] Appl. No.: 344,794

[22] Filed: Feb. 1, 1982

[30] Foreign Application Priority Data

| | | | |
|---|---|---|---|
| Feb. 6, 1981 | [JP] | Japan | 56-16413 |
| Apr. 23, 1981 | [JP] | Japan | 56-62067 |
| Apr. 24, 1981 | [JP] | Japan | 56-62181 |

[51] Int. Cl.[3] ..... G03G 5/04

[52] U.S. Cl. ..... 430/65; 430/95; 430/136; 430/526

[58] Field of Search ..... 430/69, 65, 95

[56] References Cited

U.S. PATENT DOCUMENTS

| | | | |
|---|---|---|---|
| 3,210,184 | 10/1965 | Uhlig | 430/60 X |
| 4,265,991 | 5/1981 | Hirai et al. | 430/64 |
| 4,403,026 | 9/1983 | Shimizu et al. | 430/65 |

*Primary Examiner*—John D. Welsh

*Attorney, Agent, or Firm*—Fitzpatrick, Cella, Harper & Scinto

[57] ABSTRACT

An electrophotographic image-forming member comprises (1) a substrate for electrophotography which has a surface coating of an aluminum oxide containing water chemi-structurally and (2) a photoconductive layer which is laid on said surface coating of the substrate and constituted of an amorphous material containing at least one of hydrogen atom and halogen atom in a matrix of silicon atom, said photoconductive layer containing at least one of oyxgen atom, nitrogen atom, and carbon atom.

24 Claims, 4 Drawing Figures

AMORPHOUS SILICON ELECTROPHOTOGRAPHIC IMAGE-FORMING MEMBER HAVING AN ALUMINUM OXIDE COATED SUBSTRATE

CROSS-REFERENCE TO RELATED APPLICATION

This application contains subject matter related to copending application Ser. No. 328,107, filed Dec. 7, 1981.

BACKGROUND OF THE INVENTION

1. Field of the Invention

The present invention relates to electrophotographic image-forming members, used in the field of image formation, which have sensitivity to electromagnetic waves such as light (in a broad sense, infrared rays, visible light, ultraviolet rays, X-rays, γ-rays, and the like).

2. Description of the Prior Art

Se, Si-Te, CdS, ZnO, and organic photoconductive materials such as PVCz, TNF, and the like are well-known as a photoconductive material constituting a photoconductive layer in an electrophotographic image-forming member. Meanwhile, amorphous silicon (hereinafter, represented by a-Si) has recently attracted attention as a hopeful photoconductive material, as disclosed in, for example, Ger. Pat. Offen Nos. 2746967 and 2855718, in its characteristics comparable to other photoconductive materials in photosensitivity, spectral wave region, response to light, dark resistance, etc.; additionally ease of p-n control despite its amorphous nature, and harmlessness to the human body during usage.

As mentioned above, a-Si has many superior characteristics to other photoconductive materials, and its practical application to electrophotographic image-forming members is speedily pushed forward; however, there still remain some points to be solved.

For instance, the conventional electrophotographic image-forming member having a photoconductive layer of a-Si requires further improvements in electrical, optical, and photoconductive characteristics such as dark resistance, photosensitivity, response to light, and the like, in working environment resistance such as moisture resistance, and also in stability for time passage. In order to apply a-Si to electrophotographic image-forming members practically useful over a wide range of applications, improvements in productivity and mass productivity are also necessary.

In some cases, for instance, residual potential is observed during survice operations. Repeated usage for many hours results in fatigue accumulation, thereby causing objectionable things such as a ghost phenomenon, whitening in transferred images, and the like.

Moreover, when the layer thickness becomes ten and several microns or more, the layer tends to cause a phenomenon such as floating (partial separating) or peeling from the substrate surface or formation of crack in itself with the elapse of standing time in the air after taking out from a vacuum-deposition chamber for layer formation. These phenomena tend to occur particularly in the case of a cylindrical substrate, which is commonly used in the field of electrography. Such being the case, there are points to be solved in respect to stability for time passage.

In view of the above, this invention has been accomplished as a result of extensive and intensive studies on photoconductive layers of amorphous materials containing silicon atoms as matrix, hydrogen atoms (H) and/or halogen atoms (X) [hereinafter, these amorphous materials are represented by a-Si(H,X)], in particular studies of characteristics of said layers themselves and studies of relations between said layers and substrates on which said layers are laid, from the standpoints of mechanical, electrical, photo-conductive, and durable characteristics.

The present inventors observed that it is necessary; to increase the dark resistance of a-Si(H, X) while keeping its inherent high photosensitivity; to eliminate or relax the large strain generated in the layer during layer formation, to a non-influential level by some means, since said strain causes such floating or peeling from the substrate or layer cracking; to optimize the mechanical or electrical contact between the substrate and the a-Si(H,X) layer and improve closeness between them; to establish such optimum conditions as to satisfy the above-mentioned requirements at the same time, in order to obtain an electrophotographic image-forming member excellent in electrophotographic performance characteristics, particularly in working durability. Based on these observations, the present inventors further continued extensive researches and examinations and were successful in establishing such optimum conditions.

SUMMARY OF THE INVENTION

An object of this invention is to provide an electrophotographic image-forming member excellent in electrical, optical, and photoconductive characteristics such as dark resistance, photosensitivity, and light responsiveness, in working environment resistance such as moisture resistance, and in practical aspects such as productivity, mass productivity, and the like.

Another object of the invention is to provide an electrophotographic image-forming member which does not result in fatigue accumulation, ghost phenomenon, or whitening in transferred images even when repeated usage is continued over a long time.

A further object of the invention is to provide an electrophotographic image-forming member so excellent in aging stability as not to result in the floating or peeling of its photoconductive layer from the substrate thereof or cracks in the layer.

According to one aspect of the present invention, there is provided an electrophotographic image-forming member comprising (1) a substrate for electrophotography which has a surface coating of an aluminum oxide containing water chemi-structurally and (2) a photoconductive layer which is laid on said substrate, and constituted of an amorphous material containing at least one of hydrogen atom and halogen atom in a matrix of silicon atom, said photoconductive layer containing at least one of oxygen atom, nitrogen atom, and carbon atom.

According to another aspect of the present invention, there is provided an electrophotographic image-forming member comprising (1) a substrate for electrophotography which has a surface coating of an aluminum oxide containing water chemi-structurally and (2) a photoconductive layer which is laid on said substrate and constituted of an amorphous material containing at least one of hydrogen atom and halogen atom in a matrix of silicon atom, said photoconductive layer containing oxygen atom in an amount of 0.005~20 atomic %.

According to another aspect of the present invention, there is provided an electrophotographic image-forming member comprising (1) a substrate for electrophotography which has a surface coating of an aluminum oxide containing water chemi-structurally and (2) a photoconductive layer which is laid on said substrate and constituted of an amorphous material containing at least one of hydrogen atom and halogen atom in a matrix of silicon atom, said photoconductive layer containing nitrogen atom in an amount of 0.01~20 atomic %.

According to another aspect of the present invention, there is provided an electrophotographic image-forming member comprising (1) a substrate for electrophotography which has a surface coating of an aluminum oxide containing water chemi-structurally and (2) a photoconductive layer which is laid on said substrate and constituted of an amorphous material containing at least one of hydrogen atom and halogen atom in a matrix of silicon atom, said photoconductive layer containing carbon atom in an amount of 0.001~20 atomic %.

DETAILED DESCRIPTION OF THE PREFERRED EMBODIMENTS

Figure 1:
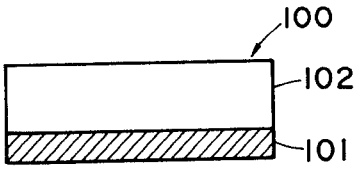
FIG. 1 is a schematic cross-sectional view illustrating the layer structure of a typical embodiment of the electrophotographic image-forming member of this invention.

Referring now to the drawings, this invention is described in detail.

FIG. 1 is a schematic cross-sectional view showing the layer structure of the most basic embodiment of the electrophotographic image-forming member of this invention.

An electrophotographic image-forming member 100 shown in FIG. 1 comprises a photoconductive layer 102 constituted of an amorphous material a-Si(H,X) which contains at least one of hydrogen atom (H) and halogen atom (X) in a matrix of silicon atom, and a substrate 101 having a surface of a chemi-structurally water-containing alumina. The substrate 101 comprises a coating of alumina containing chemi-structurally water at least on the surface thereof. The simplest way for obtain such coating is as follows: The surface of pure aluminum or aluminum alloy substrate which has been shaped and fabricated for electrophotographic use and subjected to a suitable preliminary treatment is subjected to an anodic oxidation treatment, and after a suitable pre-treatment as required, it is treated with boiling water or steam, whereby coating having a composition of $Al_2O_3.H_2O$ or $Al_2O_3.3H_2O$ can be obtained.

The anodic oxidation treatment is carried out by such method as to form a coating excellent in dielectric strength, for example, by the oxalic acid method, sulfuric acid method, chromic acid method, or the like.

The electrolytic solutions applicable, for example, in the oxalic acid method include (1) an aqueous solution containing 1 to 3% by weight of oxalic acid or its salts, (2) an aqueous solution containing 1 to 3% by weight of malonic acid or its salts, and (3) a solution of 35 g oxalic acid and 1 g $KMnO_4$ in 1 l water.

The current density and the voltage in this case, while suitably determined depending upon the electrolytic solution to be used, the material to be treated, and the like, are generally in the order of 3 to 20 Amp/dm$^2$ and of 40 to 120 V, respectively. The bath temperature during anodic oxidation ranges about 10° to 30° C.

According to the sulfuric acid method, coatings of different characteristics can be formed by varying the concentration of electrolyte from 10 to 70% by weight and the treating time from 10 to 15 minutes while keeping the voltage at 10 to 15 V. In this case, the working power ranges from 0.5 to 2 KWh/m$^2$ and the treating temperature approximately 15° to 30° C.

For example, in order to form a strong and hard coating, it is recommended to use an electrolytic solution containing 5% by weight of sulfuric acid and 5% by weight of glycerol and treat at 12 to 15 V for 20 to 40 minutes. On the contrary, a flexible coating can be prepared by the treatment at 15 V and 12° to 30° C. for 30 to 60 minutes using an electrolytic solution containing 25% by weight of sulfuric acid and 20% by weight of glycerol. A flexible coating can be also obtained by the treatment at about 15° to 20° C. using a 5 to 10% sulfuric acid containing a small amount of $Al_2(SO_4)_3$. The working power is approximately 2 KWh/m$^2$ for a hard coating and 0.5 to 1 KWh/m$^2$ for a soft coating.

In order to maximize the dielectric strength of the coating to be formed, it is recommended that the concentration of $H_2SO_4$ in the electrolytic solution is raised to 60 to 77% by weight, to which glycerol is added in a proportion of 1 part based on 15 parts of the solution by volume, and the treatment is conducted under the conditions: bath temperature 20° to 30° C., voltage about 12 V, and current density 0.1 to 1.0 Amp/dm$^2$.

The substrate treated by such anodic oxidation treatment is subjected, as required, to a suitable pretreatment such as washing, and then treated with boiling water or steam to form a coating of the final state.

The boiling water treatment can be effected by immersing said anodic oxidation-received substrate in the water demineralized, adjusted to pH 5 to 9, and heated to 80° to 100° C.

The steam treatment can be effected by thoroughly washing said substrate in advance by boiling water, treating it with a reducing aqueous solution such as $TiCl_3$, $SnCl_2$, $FeSO_4$, etc. to completely remove electrolyte components therefrom, and exposing it to superheated steam of pressure about 4 to 5.6 Kg/cm$^2$ for a period of an appropriate time.

The aluminum alloys suited for forming a coating that has desired characteristics and well matches with a photoconductive layer to be formed thereon, in this invention, include the following systems: Al-Mg-Si, Al-Mg, Al-Mg-Mn, Al-Mn, Al-Cu-Mg, Al-Cu-Ni, Al-Cu, Al-Si, Al-Cu-Zn, and Al-Cu-Si. As specific examples thereof may be cited alloys which are commercially available under the following trade names or product grade names: A51S, 61S, 63S, Aludur, Legal, Anticorodal, Pantal, SilalV, RS, 52S, 56S, Hydronalium, BS-Seewasser, 4S, KS-Seewasser, 3S, 14S, 17S, 24S, Y-Alloy, NS, RS, Silumin, American-Alloy, German-Alloy, Kupfer-Silumin, Silumin-Gamma, and the like.

The thickness of the chemi-structurally water-containing alumina coating on the substrate used in this invention, while suitably chosen in consideration of its correlations to characteristics, constituting materials, and thickness of the photoconductive layer to be formed thereon, is generally 0.05 to 10μ, preferably 0.1 to 5μ, most preferably 0.2 to 2μ.

In order to achieve the objects of this invention effectively, the photoconductive layer 102 laid over the substrate 101 is constituted of an a-Si(H,X) having one of the following semiconductive characteristics (1) to (3) and contains at least one kind of atom selected from oxygen, carbon, and nitrogen:

(1) p-Type a-Si(H,X) . . . containing acceptor alone, or both donor and acceptor, the acceptor concentration (Na) being higher than the donor concentration (Nd).

(2) n-Type a-Si(H, X) . . . containing donor alone, or both donor and acceptor, Nd being higher than Na.

(3) i-Type a-Si(H,X) . . . wherein Na≃Nd≃O or Na≃Nd.

The thickness of the photoconductive layer of electrophotographic image-forming member in this invention is determined desirably to meet the purpose of the member.

In other words, said thickness is properly determined in relation to the thickness of the above-mentioned coating formed on the surface of substrate, so that the respective functions of the photoconductive layer itself and of the substrate may be validly utilized, and thereby the objects of this invention may be effectively achieved. Usually, said thickness is preferred to be several hundred to several thousand times as thick as the thickness of the above mentioned coating. The absolute value thereof is generally in the range of 1 to 100μ, preferably 2 to 50μ.

In this invention, the formation of the photoconductive layer constituted of a-Si(H,X) is effected by the vacuum deposition method utilizing a discharge phenomenon, such as, for example, the glow discharge method, the sputtering method, or the ion plating method.

For example, the photoconductive layer constituted of an amorphous material [a-Si(H)] which contains hydrogen atoms in a matrix of silicon atom can be prepared in the following ways:

According to the glow discharge method, a silicon compound, silane, such as $SiH_4$, $Si_2H_6$, $Si_3H_8$, $Si_4H_{10}$, etc. in a gaseous form is introduced into a vacuum-deposition apparatus system together with a diluent gas such as Ar or He as required, and is decomposed by the glow discharge to deposit amorphous silicon and incorporate hydrogen atoms into the growing silicon layer.

When a photoconductive layer is formed by this glow discharge method, since the starting material for a-Si(H) formation is a hydrogen-containing silicon compound such as $SiH_4$, $Si_2H_6$, $Si_3H_8$, or $Si_4H_{10}$, hydrogen atoms are spontaneously contained in said layer during the layer is developed by the decomposition of said gaseous compound.

In this method, the photoconductive layer of a-Si(H) can be formed also by introducing $H_2$ gas in addition to said gaseous silicon compound and effecting the glow discharge decomposition of the mixed gas.

In the case of the reaction sputtering method, sputtering is effected by using Si as target in an atmosphere of a diluent gas such as He or Ar, or a mixed gas based thereon, during which $H_2$ gas or a gaseous silicon compound such as $SiH_4$, $Si_2H_6$, $Si_3H_8$, or $Si_4H_{10}$ may be introduced, or for the additional purpose of impurity addition, $B_2H_6$, $PH_3$ or some other gas may be introduced.

The photoconductive layer of amorphous material [a-S(X)] which contains halogen atoms in a matrix of silicon atom or of amorphous material [a-Si(H+X)] which contains both hydrogen atoms and halogen atoms in a matrix of silicon atom can be formed in the following ways:

In the case of the glow discharge method, a raw material gas for incorporating halogen is introduced into a deposition chamber which can be brought internally to reduced pressure, together with a Si-producing raw material gas, e.g., the above-mentioned silane compound, and a glow discharge is generated in said deposition chamber to form a layer of a-Si(X) or a-Si(H+X) on the surface of a prescribed substrate previously fixed to a predetermined position in the chamber. In the case of the sputtering method, a target of Si is sputtered in an atmosphere of a diluent gas, e.g., Ar or He, or of a mixed gas based thereon, during which a raw material gas for halogen incorporation may be fed into the deposition chamber.

The raw material gases effectively used for incorporating halogen, in this invention, include many halogen compounds. For instance, suitable ones are gaseous or gasifiable halogen compounds such as halogen gas, interhalogen compounds, and silane derivatives substituted by halogen.

Additionally, as effective ones, there may be cited gaseous or gasifiable, halogen-containing silicon compounds such as silane derivatives substituted by halogen, which can produce silicon atoms and halogen atoms at the same time.

The halogen compounds favorably used in this invention include, for example, halogen gas such as fluorine, chlorine, bromine, and iodine and interhalogen compounds such as BrF, ClF, $ClF_3$, $BrF_3$, $BrF_5$, $IF_7$, $IF_3$, ICl, IBr, and the like.

The halogen-containing silicon compounds, i.e., silane derivatives substituted by halogen, favourably used include, for example, $SiF_4$, $Si_2F_6$, $SiCl_3Br$, $SiCl_2Br_2$, $SiClBr_3$, $SiCl_3I$, $SiBr_4$, and the like.

When photoconductive members characteristic of this invention are prepared by the glow discharge method employing such halogen-containing silicon compound, a photoconductive layer of a-Si(X) or a-Si(H+X) can also be formed on a prescribed substrate without using a silane gas which is generally used as a silicon-producing raw material.

In the basic process of forming a photoconductive layer of a-Si(X) according to the glow discharge method, a Si-producing raw material gas and a halogen-incorporating raw material gas are used together with a diluent gas such as Ar, Ne, He, etc. as required, these gases are introduced into a photoconductive layer forming deposition chamber with the mixing ratio and flows of the gases regulated to prescribed values, a glow discharge is generated to produce a plasmic atmosphere of these gases, whereby a photoconductive layer of a-Si(X) can be formed on a prescribed substrate; however, such photoconductive layer can also be formed by additional mixing of hydrogen gas or a hydrogen-containing gaseous compound in a prescribed proportion.

These gaseous compounds of each group may be used alone or in combination.

The formation of a photoconductive layer of a-Si(X) or a-Si(H+X) according to the reaction sputtering method can be effected by sputtering a target of Si in a prescribed gas plasmic atmosphere. The formation of such photoconductive layer according to the ion plating method can be effected by placing polycrystals or single crystals of silicon as vapor source in an evaporator boat, heating this silicon vapor source with a resistance heater or electron beams (EB method) to vaporize the silicon, and passing the vaporized flying matter through a prescribed gas plasmic atmosphere.

In this case, in order to incorporate halogen atoms and if necessary, also hydrogen atoms into the layer to be formed, according to either the sputtering method or the ion plating method, a halogen compound or halogen-containing silicon compound cited above or additionally hydrogen gas or a hydrogen-containing gaseous compound may be introduced into the deposition chamber and a plasmic atmosphere of these gases may be formed.

In this invention, while the above-cited halogen compounds and halogen-containing silicon compounds can be used as an effective halogen-incorporating raw material gas, the following compounds can also be used as an effective starting material for forming such photoconductive layer: gaseous or gasifiable halogenated compounds which contain hydrogen as one of constitutents including: hydrogen halides such as HF, HCl, HBr, and HI; and halogen substituted silicon hydrides such as $SiH_2F_2$, $SiH_2Cl_2$, $SiHCl_3$, $SiH_3Cl$, $SiH_3Br$, $SiH_2Br_2$, $SiHBr_3$, etc.

These hydrogen-containing halogenated compounds are used in this invention as a suitable halogen-incorporating raw material because, when these compounds are used for the formation of photoconductive layer, hydrogen atoms, which are very effective in controlling electrical or photoelectric characteristics of the layer, are incorporated into the layer simultaneously with the incorporation of halogen atoms.

The halogen atom (X) suitable as a constituent of the photoconductive layer formed, in this invention, includes F, Cl, Br and I, of which F, Cl and Br are preferable.

The hydrogen atom (H) content, halogen atom (X) content, or (H+X) content in the photoconductive layer formed, in this invention, is generally 1 to 40 atomic %, preferably 5 to 30 atomic %.

The control of (H) content, (X) content, or (H+X) content is effected through controlling, for example, the substrate temperature during the deposition, and/or the amount of the (H)−, (X)−, or (H+X)-incorporating starting material to be fed into the deposition chamber, the power of the discharge for the deposition, and the like.

In order to give a semiconductor type (1) to (3), mentioned above, to the photoconductive layer, the layer is doped with a controlled amount of n-type impurity, p-type impurity, or both of them during the formation of layer by the glow discharge method, the reaction sputtering method, or some other method.

The photocondutive layer-doping impurities, which govern the conduction type, suitably used in this invention include, as p-type impurities, elements in the group III-A of the periodic table, e.g., B, Al, Ga, In, Tl, and the like and, as n-type impurities, elements in the group V-A of the periodic table, e.g., N, P, As, Sb, Bi, and the like.

The content of impurity doping the photoconductive layer is up to $3\times10^{-2}$ atomic % for said elements of the group III-A and is up to $5\times10^{-3}$ atomic % for said elements of the group V-A. In order to give a $n^-$-type character to the photoconductive layer, the layer may be formed without doping with any conduction-governing impurity.

Incorporation of oxygen atoms into the photoconductive layer to be formed, in this invention, is carried out as follows:

In the case of the glow discharge method, a gaseous or readily gasifiable oxygen compound such as oxygen or an oxide is introduced into a deposition chamber, possible to evacuate, in a gaseous form along with a silicon-containing, photoconductive layer-forming raw material gas, and a glow discharge is generated in the deposition chamber, whereby an oxygen-containing photoconductive layer can be obtained.

In the case of the sputtering method, a target formed from a $Si\text{-}SiO_2$ mixture of a desired mixing ratio or two sheets of target, a Si wafer and a $SiO_2$ wafer, is subjected to sputtering; or oxygen gas or an oxygen-containing gaseous compound is introduced into a deposition chamber along with a base gas for sputtering, such as Ar gas, and a Si or $(Si+SiO_2)$ target is subjected to sputtering, whereby an oxygen-containing photoconductive layer can be obtained.

As to the oxygen compound used in this invention, most oxygen compounds can be used provided that they result in incorporation of oxygen atoms in an effective form into the formed photoconductive layer without incorporating any unnecessary impurity into the layer; oxygen compounds gaseous at ordinary temperature are favorable.

Such oxygen compounds include, for example, ozone ($O_3$), carbon monoxide (CO), carbon dioxide ($CO_2$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), and lower siloxanes, as disiloxane ($H_3SiOSiH_3$), trisiloxane ($H_3SiOSiH_2OSiH_3$), and the like, which consist of Si, O, and H.

The oxygen content in the photoconductive layer must be properly selected as desired; however, it is generally 0.005 to 20 atomic %, more preferably 0.01 to 15 atomic %, most preferably 0.015 to 10 atomic %.

In order to incorporate carbon atoms into the photoconductive layer formed, in this invention, for example when the glow discharge method is applied to the formation of the photoconductive layer, a gaseous or readily gasifiable carbon compound is introduced into a deposition chamber possible to evacuate in a gaseous form along with a silicon-containing, photoconductive layer forming raw material gas, and a glow discharge is generated in the deposition chamber to form a photoconductive layer.

The suitable carbon-incorporating sources used for this purpose in this invention include many gaseous or readily gasifiable carbon compounds, for instance, $C_1$–$C_5$ saturated hydrocarbons, $C_2$–$C_5$ ethylene series hydrocarbons, and $C_2$–$C_4$ acetylene series hydrocarbons.

More specifically may be cited, as saturated hydrocarbons, methane ($CH_4$), ethane ($C_2H_6$), propane ($C_3H_8$), n-butane (n-$C_4H_{10}$), and pentane ($C_5H_{12}$); as ethylene series hydrocarbons, ethylene ($C_2H_4$), propylene ($C_3H_6$), butene-1 ($C_4H_8$), butene-2 ($C_4H_8$), isobutylene ($C_4H_8$), and pentene ($C_5IO_{10}$); and as acetylene series hydrocarbons, acetylene ($C_2H_2$), methylacetylene ($C_3H_4$), and butyne ($C_4H_6$), and the like.

Besides these hydrocarbons, the following compounds can be effectively used as a carbon-incorporating source containing Si, C and H silane derivatives such as alkyl silanes, e.g. $Si(CH_3)_4$, $Si(C_2H_5)_4$, etc., and halogen-containing alkyl silane, e.g. $SiCl(CH_3)_3$, $SiCl_2(CH_3)_2$, $SiCl_3CH_3$, etc.; and as a carbon-incorporating source containing carbon and halogen halogen-substituted paraffin hydrocarbons such as $CCl_4$, $CHF_3$, $CH_2F_2$, $CH_3Cl$, $CH_3Br$, $CH_3I$, $C_2H_5Cl$, etc.

The formation of a carbon-containing photoconductive layer by the sputtering method may be effected as follows: a single crystalline or polycrystalline Si wafer is subjected to sputtering in an atmosphere of carbon-incorporating raw material gas; or two wafers (a C wafer and a singlecrystalline or polycrystalline Si wafer) or a Si and C mixed wafer is subjected to sputtering.

For example, when a Si wafer is used as target, a raw material gas, as cited for the grow discharge method as examples of carbon- and hydrogen-incorporating or carbon- and halogen-incorporating raw material gas, is introduced, together with a diluent gas as required, into a deposition chamber, and said Si wafer is subjected to sputtering in a plasma of these gases.

Alternatively, two separate targets, a Si target and a C target, or a single target of Si-C mixture is subjected to sputtering in an atmosphere of at least hydrogen- or halogen-containing gas, whereby a carbon-containing photoconductive layer can be obtained.

The carbon content in the photoconductive layer must be suitably determined as desired; however, it is generally 0.001 to 20 atomic %, more preferably 0.005 to 15 atomic %, most preferably 0.01 to 10 atomic %.

In order to incorporate nitrogen atoms into a growing photoconductive layer by the glow discharge method, ion plating method, or reaction sputtering method, a nitrogen-incorporating raw material gas may be fed into a photoconductive layer forming deposition chamber while controlling the gas flow to match the growth of the layer. In the case of the sputtering method, besides the above way, a target for nitrogen incorporation is set in the deposition chamber and sputtered at a rate to match the growth of the layer.

The raw material gases suitable for said nitrogen incorporation in this invention include many gaseous or readily gasifiable nitrogen compounds, i.e. nitrogen-containing or nitrogen- and hydrogen-containing, gaseous or readily gasifiable compounds such as, for example, nitrogen ($N_2$), ammonia ($NH_3$), hydrazine ($H_2NNH_2$), hydrogen azide ($HN_3$), ammonium azide ($NH_4N_3$), and the like. Besides these, halogenated nitrogen compounds such as nitrogen trifluoride ($F_3N$), dinitrogen tetrafluoride ($F_4N_2$), and the like may cited as a raw material gas capable of incorporating halogen atoms simultaneously with the incorporation of nitrogen atoms.

The formation of nitrogen-containing photoconductive layer by the sputtering method can be effected as follows: a single- or polycrystalline Si wafer, a $Si_3N_4$ wafer, or a wafer of Si-$Si_3N_4$ mixture is employed as target and sputtered in various gas atmospheres or a single- or polycrystalline Si wafer is sputtered in an atmosphere of raw material gas for carbon incorporation.

For example, when a Si wafer is employed as target, a raw material gas for nitrogen incorporation or as necessary a raw material gas for nitrogen and hydrogen and/or halogen incorporations, e.g. $N_2$ with $H_2$ or $NH_3$, is introduced into a deposition chamber for sputtering use, and sputtered in a plasma of the introduced gas.

Alternatively, separate targets of Si and of $Si_3N_4$ or a single target of Si-$Si_3N_4$ mixture is sputtered in an atmosphere of diluent gas for sputtering or in an atmosphere of at least hydrogen-containing and/or halogen-containing compound's gas, whereby a nitrogen-containing photoconductive layer can be obtained.

It is also included in preferred embodiments of this invention to introduce two or more kinds of atoms selected from nitrogen, carbon, and oxygen, into the photoconductive layer for the purpose of achieving effects of this invention.

The photoconductive layer in the electrophotographic image-forming member of this invention comprises, in principle, a-Si(H,X), but can also be made up of an amorphous material that contains germanium atoms in addition to the constituents of said a-Si(H,X) [such amorphous material is represented by a-SiGe(H,X)].

The formation of a photoconductive layer of a-SiGe(H,X) on a prescribed substrate by introducing positively germanium atoms in the growing photoconductive layer is carried out in the following way:

For instance, in the case of the glow discharge method, in addition to the gas as used in the foregoing glow discharge method of forming the photoconductive layer of a-Si(H,X), a germanium compound such as a germanium hydride, e.g. $GeH_4$, $Ge_2H_6$, or $Ge_3H_8$, etc. of a germanium hydrogenhalide, e.g. $Ge_2H_2Cl_2$ or $GeH_3Cl$, etc. is introduced into a vacuum-deposition chamber in a gaseous form, and decomposed by generating a glow discharge, whereby the intended photoconductive layer of a-SiGe(H,X) can be obtained.

In the case of the reaction sputtering method, the same operations as the above-described formation of the photoconductive layer of a-Si(H,X) are performed except that in addition a germanium compound gas mentioned above is introduced into the vacuum-deposition chamber, or a Ge target together with the Si target is used or a SiGe target is used, whereby a photoconductive layer of a-SiGe(H,X) can be formed on a prescribed substrate.

The electrophotographic image-forming member of this invention described above in detail has advantages of exhibiting high photosensitivity, high dark resistance, residual potential not at all or, if any, to an extent almost negligible, and excellent in charge retentivity on charge treatment; securing good mechanical and electrical contact and firm adhesion between its supporting substrate and photoconductive layer, hence not resulting in floating or peeling of the photoconductive layer from the substrate or cracks in the layer; not showing decrease in initial performance characteristics even when image formation is repeated for a long period of time; and giving toner tranferred images of high quality and of high degree of resolution.

In the present invention, the content of oxygen atom, nitrogen atom or carbon atom is uniform in the direction of the thickness of the photoconductive layer.

EXAMPLE 1

A mirror-finished aluminum alloy 52S (containing Si, Mg, and Cr) substrate of 1 mm thick and 10 cm × 10 cm wide was washed successively with alkali, acid, and pure water. The substrate was subjected to anodic oxidation at 18° C. for about 5 minutes in a 7% sulfuric acid containing 5 g of aluminum sulfate per liter, and then was taken out from the sulfuric acid solution, quickly immersed in pure boiling water, and taken out after about 10 minutes. The thickness of the coating layer over the aluminum alloy substrate thus treated was about 0.8μ.

Figure 2:
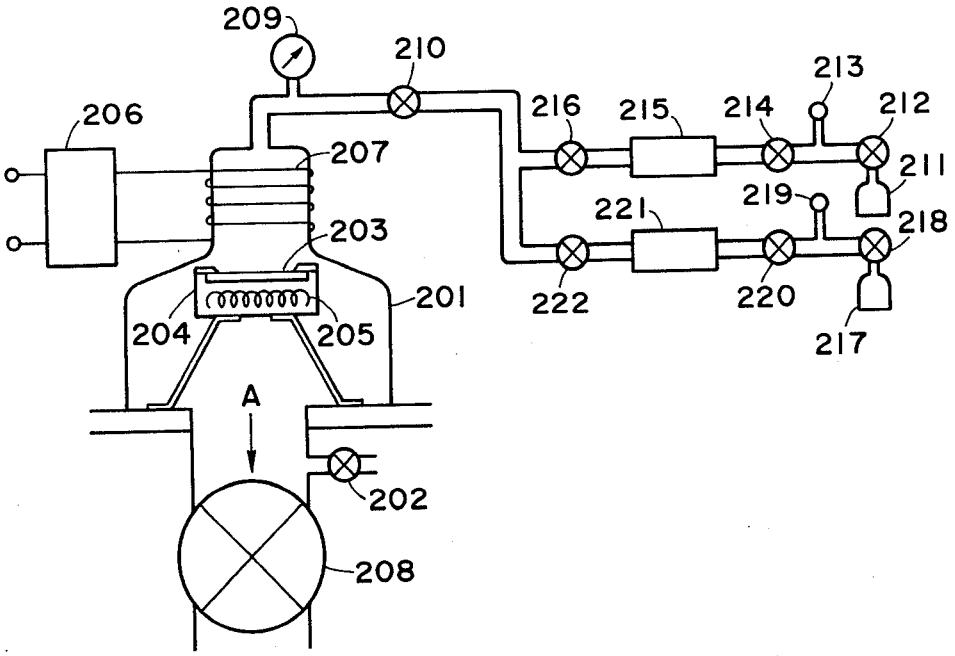
FIGS. 2 to 4 are diagrammatic views each illustrating an embodiment of apparatus for forming the electrophotographic image-forming member of this invention.

Subsequently, electrophotographic image-forming members of this invention were prepared in the following ways by using the apparatus of which a schematic view is shown in FIG. 2, and were treated for image formation.

The substrate treated as the above, after its surface was cleaned again by sufficient washing with water and drying, was fastened to a predetermined position, about 5 cm apart from a heater 205 in a fixing member 204, on the fixing member 204 which has been set up in a definite position in a glow discharge deposition chamber 201. After confirmation that all valves in the system were in the close position, a main valve 208 was fully opened and the chamber 201 was evacuated to about $5\times10^{-6}$ Torr. Then the heater 205, which was capable of heating the substrate 203 with a precision of ±0.5° C., was switched on to raise the substrate temperature, which was then settled to a constant value of 400° C. by controlling the input voltage of the heater 205 while detecting the substrate temperature by a thermocouple (alumel-chromel), which had been fitted into the fixing member 204 to directly detect the temperature of the rear surface of the substrate.

Thereafter, an auxiliary valve 210 and then outflow valves 216 and 222 and inflow valves 214 and 220 were fully opened to thoroughly evacuate flow meters 215 and 221 also. After the auxiliary valve 210 and valves 214, 216, 220 and 222 were closed, the valve 212 of a $SiH_4$ gas (99.999% purity) bomb 211 was opened and the pressure of an outlet pressure gauge 213 was adjusted to 1 Kg/cm$^2$. The inflow valve 214 was gradually opened to introduce $SiH_4$ gas into the flow meter 215. Succeedingly, the outflow valve 216 and then the auxiliary valve 210 were gradually opened, and the inner pressure of the chamber was settled to $1\times10^{-2}$ Torr by controlling the opening of the auxiliary valve 210 while watching the reading of a Pirani gauge 209. Then, the main valve 208 was gradually turned off until the indication of the Pirani gauge came to 0.5 Torr. After the inner pressure was confirmed to be stabilized, the valve 218 of a $NO_2$ gas (99.999% purity) bomb 217 was opened, the pressure of an outlet pressure gauge 219 was adjusted to 1 Kg/cm$^2$, and the inflow valve 220 was gradually opened to introduce $NO_2$ gas into the flow meter 221. Then, the outflow valve 222 was gradually opened, and its opening was settled so that the reading of the flow meter 221 might become 0.5 vol. % of the flow amount of $SiH_4$ gas. A high-frequency power source 206 was switched on to apply 13.56 MHz high-frequency power to an induction coil 207 and generate a glow discharge in an inner space (an upper space of the chamber) surrounded by the induction coil, where the input power was regulated to 30 W. The glow discharge was continued for 8 hours while keeping these conditions, and thereby a photoconductive layer was formed on the substrate. Then, the high-frequency power source 206 was switched off to stop the glow discharge. Successively, the source for the heater 205 was switched off, and after the substrate temperature dropped to 100° C., the auxiliary valve 210 and the outflow valves 216 and 222 were closed and the main valve 208 was fully opened to evacuate the chamber to $1\times10^{-5}$ Torr or less. Thereafter, the main valve 208 was closed, the inner pressure of the chamber 201 was returned to the atmospheric value by means of a leak valve 202, and the photoconductive layer-overlaid substrate was taken out. The entire thickness of the photoconductive layer formed was about 18μ.

The image-forming member thus prepared was set in a charging, exposing testing machine, corona-charged at ⊖ 6 KV for 0.2 second, and immediately thereafter, exposed to a pattern of light, which was irradiated in a quantity of 1.0 lux.sec from a tungsten lamp through a transmission type of test chart.

Immediately thereafter, the surface of the image-forming member was exposed to a cascading positive-charged developer (containing toner and carrier), and a good toner image was formed thereon. A process of transferring the toner image formed on the image-forming member, to transfer paper by a ⊕ 5 KV corona charge was repeated 100,000 times with the result that a clear and dense image excellent in resolution was obtained on every transfer paper with good gradation reproducibility.

EXAMPLE 2

Electrophotographic image-forming members (Sample Nos. 2-1 to 2-23) were prepared in nearly the same conditions and procedures as Example 1 except that the kind of raw material gas for photoconductive layer formation was varied as shown in Table 1 and the gas flow ratio was adjusted to various values, to change the oxygen content in the photoconductive layer to be formed.

These samples, which were found all highly photosensitive, were treated for image formation by the electrophotographic process, and repeatability of these samples were evaluated on the basis of the quality of the toner image transferred to transfer paper. The results showed that every sample gave a high resolution, high quality image similar to the first image even at the 100,000th repetition of image formation, thus demonstrating the excellent practical usefulness of the electrophotographic image-forming member of this invention.

TABLE 1

| Sample No. | Raw material gas | Oxygen content in photoconductive layer (atomic %) | Image quality durability-summarized rating* |
|---|---|---|---|
| 2-1 | $SiH_4$,$O_2$, Ar | 0.005 | Δ |
| 2-2 | " | 0.007 | Δ |
| 2-3 | " | 0.01 | ○ |
| 2-4 | " | 0.015 | ◎ |
| 2-5 | " | 0.1 | ◎ |
| 2-6 | " | 1.0 | ◎ |
| 2-7 | " | 5.0 | ◎ |
| 2-8 | " | 10 | ◎ |
| 2-9 | " | 15 | ○ |
| 2-10 | " | 20 | Δ |
| 2-11 | $SiH_4$, $Si_2H_6$, $O_2$, Ar | 0.03 | ◎ |
| 2-12 | $SiH_2H_6$,$O_2$, Ar | " | ◎ |
| 2-13 | $SiF_4$, $SiH_4$, $O_2$, Ar | " | ◎ |
| 2-14 | $SiH_4$, $B_2H_6$, $O_2$, Ar | " | ◎ |
| 2-15 | $SiH_4$, $B_2H_6$, $NO_2$, Ar | " | ◎ |
| 2-16 | $SiF_4$, $SiH_4$, $B_2H_6$, $O_2$, Ar | " | ◎ |
| 2-17 | $Si_2H_6$, $B_2H_6$, $O_2$, Ar | " | ◎ |
| 2-18 | $SiH_4$, $Si_2H_6$, $B_2H_6$, $O_2$, Ar | " | ◎ |
| 2-19 | $SiH_4$, $Si_2H_6$, $CO_2$, Ar | " | ◎ |
| 2-20 | $SiH_4$, $Si_2H_6$, $NO_2$, Ar | " | ◎ |
| 2-21 | $SiH_4$, NO, Ar | " | ◎ |
| 2-22 | $SiH_4$, $Si_2H_6$, NO, Ar | " | ◎ |
| 2-23 | $SiH_4$, $SiF_4$, NO, Ar | " | ◎ |

* ◎ Excellent;
○ Good;
Δ Sufficient for practical use

EXAMPLE 3

A mirror-finished aluminum alloy 61S (containing Cu, Si, and Cr) substrate of 1 mm thick and 10 cm×10 cm wide was subjected to anodic oxidation in the same manner as Example 1, and after thoroughly dried, it was left standing for 20 minutes in a superheated steam bath at 3 atm. Using this substrate, an image-forming member was prepared and evaluated for image quality and durability in the same way as Example 1, giving similar good results.

EXAMPLE 4

Image-forming members were prepared and evaluated for image quality and repeatability, in the same manner as Example 1, except that the thickness of coating layer on the substrate surface was varied by changing the anodic oxidation time, and the development was carried out by the magnetic brush development process, wherein such a development bias value was applied to each image-forming member as to give the best image. The results are shown in Table 2.

TABLE 2

| Thickness of coating layer (μ) | First image quality | Repeatability | Rating |
|---|---|---|---|
| 0.03 | X (Image density: low) | X (Ground fog soon developed) | X |
| 0.1 | Δ (Image density: somewhat low) | ○ (Ground fog developed in the negligible extent) | ○ |
| 0.5 | ○ (Image density: high | ○ (Ground fog developed in the negligible extent) | ◎ |
| 2 | ○ (Image density: high) | ○ (Ground fog developed in the negligible extent) | ◎ |
| 5 | ○ (Image density: high) | Δ (Ground fog gradually developed) | ○ |
| 20 | ○ (Image density: high) | X (Ground fog soon developed) | X |

EXAMPLE 5

Figure 3:
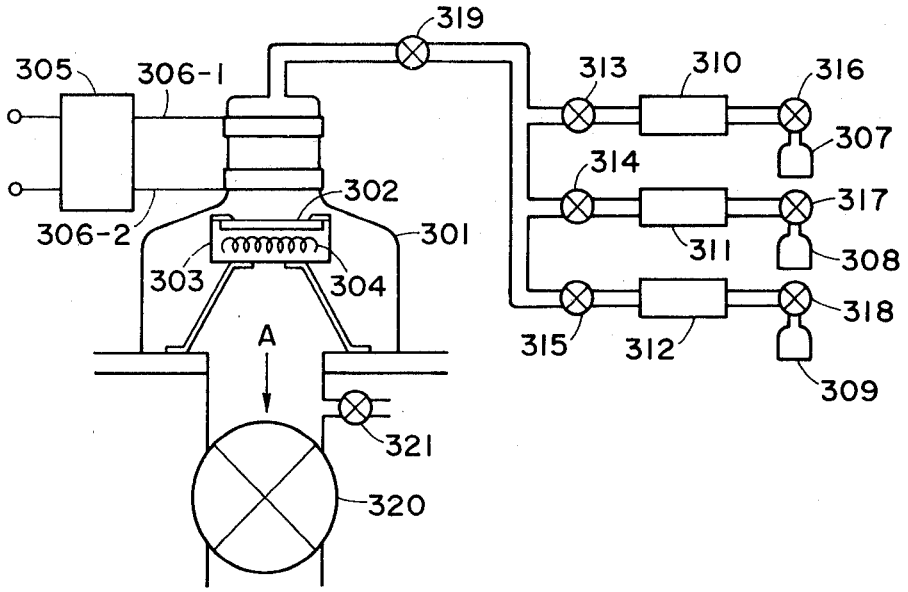

Using a substrate treated in the same manner as Example 1 and an apparatus as shown in FIG. 3, an electrophotographic image-forming member was prepared as follows.

The substrate 302 was securely fastened to a predetermined position, about 5 cm apart from a heater 304, on a fixing member 303 which had been set up in a definite position in a glow discharge deposition chamber 301.

Then, a main valve 320 was fully opened, and the deposition chamber 301 was evacuated to about $5\times10^{-5}$ Torr Then, the heater 304 was switched on to heat the substrate uniformly to 100° C., and kept at this temperature. An axiliary valve 319 and succeedingly the respective needle valves 313, 314, and 315 of bombs 307, 308, and 309 were fully opened, and thereafter flow control valves 316, 317, and 318 were gradually opened to introduce $NO_2$ gas from the bomb 307, $SiH_4$ gas from the bomb 308, and $GeH_4$ gas from the bomb 309 into the deposition chamber 301. The $H_2$:$SiH_4$:$GeH_4$ flow ratio was kept at 0.02:0.75:0.25 by controlling the valves 316, 317, and 318.

Further the main valve 320 was controlled to hold the vacuum in the deposition chamber to about 0.8 Torr.

Then, a high-frequency power source 305 was switched on, and 13.56 MHz high-frequency power was applied between electrodes 306-1 and 306-2 to generate a glow discharge, thereby forming a photoconductive layer on said substrate. The glow discharge power in this case was 3 W.

Thus, the discharge was continued for about 17 hours and thereby an oxygen-containing a-SiGe(H) layer of about 20μ in thickness was formed. The image-forming member obtained in this way was tested by using the machine mentioned in Example 1, giving good results as to both image quality and repeatability.

EXAMPLE 6

Figure 4:
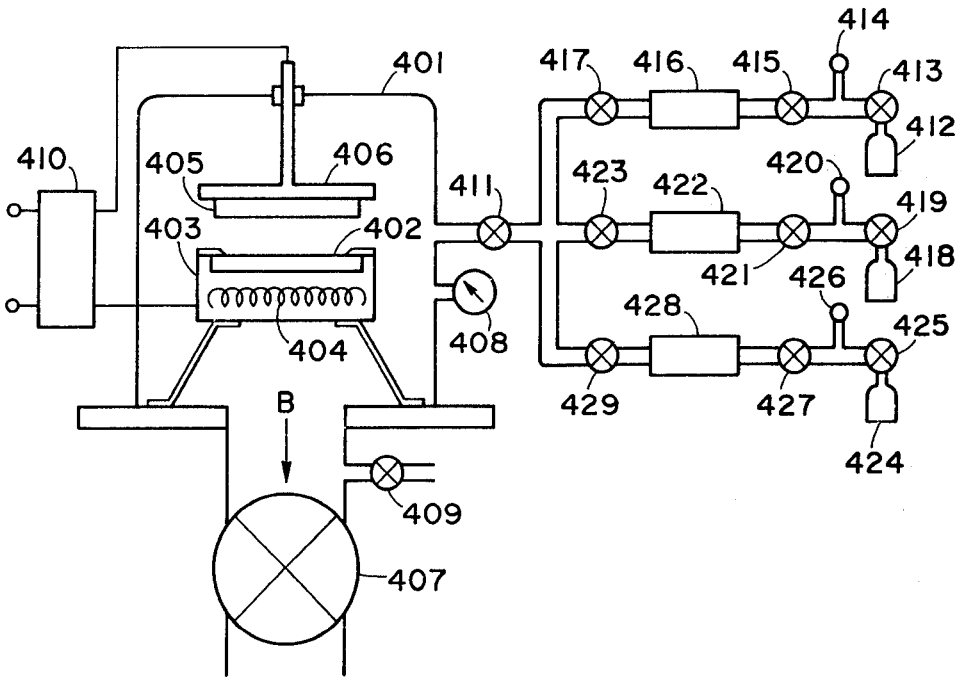

Using an apparatus as shown in FIG. 4, an electrophotographic image-forming member was prepared in the following way.

An aluminum plate, 0.2 mm thick and 10 cm×10 cm wide, which had undergone pretreatments in the same manner as Example 1 was fastened, as substrate, onto a fixing member 403 containing a heater 404 and a thermocouple, in a sputtering vacuum-deposition chamber 401. On an electrode 406 oposite to the substrate 402, a polycrystalline silicon plate (99.999% purity) target was fixed so as to oppose and parallel to the substrate 402 and be about 4.5 cm apart from it.

The chamber 401 was once evacuated to about $5\times10^{-7}$ Torr by fully opening a main valve 407 (during this operation, all the valves of the system were in the close position), then an auxiliary valve 411 and outflow valves 417, 423, and 429 were opened and after sufficient evacuation, were closed. The heater source was switched on to heat and keep the substrate 402 at 200° C. The valve 413 of a hydrogen (99.99995% purity) bomb 412 was opened and the outlet pressure was adjusted to 1 kg/cm$^2$ with the aid of an outlet pressure gauge 414. Succeedingly, an inflow valve 415 was gradually opened to introduce hydrogen gas into a flow meter 416, then the outflow valve 417 was gradually opened, and further the auxiliary valve 411 was opened to introduce hydrogen into the chamber 401. The hydrogen introduction was controlled through the outflow valve 417 while detecting a pressure gauge 408, so as to raise and stabilize the inner pressure of the chamber 401 to $5\times10^{-5}$ Torr.

Then, the valve 419 of an argon gas (99.9999% purity) bomb 418 was opened and controlled so that the reading of an outlet pressure gauge 420 might come to 1 kg/cm$^2$, and an inflow valve 421 was opened. Successively, the outflow valve 423 was gradually opened and controlled to introduce argon gas so as to raise and stabilize the inner pressure of the chamber $5\times10^{-4}$ Torr. After the flow became stabilized under these conditions, the main valve 407 was gradually closed and its opening was restricted to raise the inner pressure of the chamber up to $1\times10^{-2}$ Torr.

Successively, the valve 425 of a $NO_2$ gas (99.99% purity) bomb 424 was opened and controlled to adjust the reading of an outlet pressure gauge 426 to 1 Kg/cm$^2$, an inflow valve 427 was opened, and the outflow valve 429 was gradually opened and controlled to introduce $NO_2$ gas and adjust the $NO_2$ gas flow indicated by a flowmeter 428, to about 5 vol. % of hydrogen gas flow indicated by the flowmeter 422.

After the stabilization of the flowmeters 416, 422 and 428 had been ascertained, a high-frequency power source 410 was switched on to apply high-frequency power of 13.56 MHz, 500 W, and 1.6 KV between the target 405 and the fixing member 403. A photoconductive layer was formed while controlling the generated discharge to continue stably under these conditions. The discharge was continued in this way for 8 hours to form the layer.

The high-frequency power source 410 and the source of the heater 404 were switched off, and after the substrate temperature had fallen to 100° C. or less, the outflow valves 417, 423, and 429 and then the auxiliary valve 411 were closed, and thereafter the main valve 407 was fully opened to exclude the gases from the system. Then, the main valve 407 was closed and a leak valve 409 was opened to return the pressure in the chamber to the atmospheric value, and the substrate on which a photoconductive layer was formed was taken out.

The thickness of the photoconductive layer formed in this case was 18μ.

The image-forming member thus obtained was tested in the same manner as Example 1, with the result that an image excellent in resolution, gradation, and image density was obtained when corona charging at ⊖ 6 KV and development by a positive-charged developer were combined.

EXAMPLE 7

An electrophotographic image-forming member was prepared by the same procedures and under the same conditions as Example 1 except that $N_2$ gas (99.999% purity) was used in place of $NO_2$ gas and the flow amount of $N_2$ gas was 5 vol. % of $SiH_4$ gas flow. This image-forming member was subjected to the same image-forming treatments under the same conditions as Example 1, giving a clear and dense image excellent in resolution and good in gradation reproducibility.

EXAMPLE 8

Electrophotographic image-forming members (sample Nos. 8-1 to 8-17) were prepared by nearly the same procedures and under nearly the same conditions as Example 7, except that the nitrogen content in the photoconductive layer to be formed was varied by changing the kinds of raw material gases for photoconductive layer formation as shown in Table 3 and adjusting the gas flow amount ratio to various values. These samples, which were found all highly photosensitive, were treated for image formation by the electrophotographic process, and the repeatability thereof were evaluated on the basis of the quality of the toner image transferred to transfer paper. The results showed that, even at the 100,000th repetition of image formation, every sample gave a high resolution, high quality image equal to the first image, thus demonstrating the excellent practical usefulness of the electrophotographic image-forming member of this invention.

TABLE 3

| Sample No. | Raw material gas | Nitrogen content in photoconductive layer (atomic %) | Image quality/durability-summarized rating* |
|---|---|---|---|
| 8-1 | $SiH_4$, $N_2$, Ar | 0.01 | Δ |
| 8-2 | " | 0.02 | Δ |
| 8-3 | " | 0.03 | |
| 8-4 | " | 0.05 | ○ |

TABLE 3-continued

| Sample No. | Raw material gas | Nitrogen content in photoconductive layer (atomic %) | Image quality/durability-summarized rating* |
|---|---|---|---|
| 8-5 | " | 0.1 | ◎ |
| 8-6 | " | 1.0 | ◎ |
| 8-7 | " | 5.0 | ◎ |
| 8-8 | " | 10 | ◎ |
| 8-9 | " | 15 | ◎ |
| 8-10 | " | 20 | ○ |
| 8-11 | $SiH_4$, $Si_2H_6$, $NH_3$, Ar | 1.0 | Δ |
| 8-12 | $Si_2H_6$, $NH_3$, Ar | 1.0 | ◎ |
| 8-13 | $SiF_4$, $SiH_4$, $N_2$, Ar | 1.0 | ◎ |
| 8-14 | $SiH_4$, $B_2H_4$, $NH_3$, Ar | 1.0 | ◎ |
| 8-15 | $SiH_4$, $B_2H_6$, $NH_3$, Ar | 1.0 | ◎ |
| 8-16 | $SiF_4$, $SiH_4$, $B_2H_6$, $NH_3$, Ar | 1.0 | ◎ |
| 8-17 | $Si_2H_6$, $B_2H_6$, $N_2$, Ar | 1.0 | ◎ |

* ◎ Excellent;
○ Good;
Δ Sufficient for practical use

EXAMPLE 9

Image-forming member was prepared by using a substrate treated in the same manner as Example 3 according to the same way as Example 7. The resulting image-forming member was excellent in image quality and durability.

EXAMPLE 10

Image-forming members were prepared and evaluated for image quality and repeatability, in the same manner as Example 7, except that the thickness of coating layer on the substrate surface was varied by changing the anodic oxidation time, and the development was carried out by the magnetic brush development process, wherein such a development bias value was applied for each image-forming member as to give the best image. The results are shown in Table 4.

TABLE 4

| Thickness of coating layer (μ) | First image quality | Repeatability | Rating |
|---|---|---|---|
| 0.03 | X (image density: low) | X (Ground fog soon developed) | X |
| 0.1 | Δ (image density: somewhat low) | ○ (Ground fog developed in the negligible extent) | ○ |
| 0.5 | ○ (image density: high) | ○ (Ground fog developed in the negligible extent) | ◎ |
| 2 | ○ (image density: high) | ○ (Ground fog developed in the negligible extent) | ◎ |
| 5 | ○ (image density: high) | Δ (Ground fog gradually developed) | ○ |
| 20 | ○ (image density: high) | X (Ground fog soon developed) | X |

EXAMPLE 11

An electrophotographic image-forming member was prepared by the same procedures under the same conditions as Example 5 except that $NH_3$ gas diluted to a concentration of 1 vol % with $H_2$ [represented by "$NH_3(1)/H_2$"] was used in place of $NO_2$ gas. The resulting image-forming member was tested by using the same machine as mentioned in Example 1, giving good results as to both image quality and repeatability.

EXAMPLE 12

An electrophotographic image-forming member was prepared by the same procedures and under the same conditions as Example 6 except that $N_2$ gas was used in place of $NO_2$ gas. The resulting image-forming member was tested in the same manner as Example 6, with the result that an image excellent in resolution gradation, and image density was obtained when corona charging at ⊖ 6 KV and development by a positive-charged developer were combined.

EXAMPLE 13

An electrophotographic image-forming member was prepared by the same procedures and under the same conditions as Example 1 except that $C_2H_4$ gas (99.999% purity) was used in place of $NO_2$ gas and the flow amount of $C_2H_4$ gas was 0.05 vol. % of $SiH_4$ gas flow. Said image-forming member was subjected to the same image-forming treatments and under the same conditions as Example 1, giving a clear and dense image excellent in resolution and good in gradation reproducibility.

EXAMPLE 14

Electrophotographic image-forming members (sample Nos. 14-1 to 14-23) were prepared by nearly the same procedures and under nearly the same conditions as Example 13, except that the carbon content in the photoconductive layer was varied by changing the kinds of raw material gases for photoconductive layer formation as shown in Table 5 and adjusting the gas flow amount ratio to various values. These samples, which were found all highly photosensitive, were treated for image formation by the electrophotographic process, and repeatability thereof were evaluated on the basis of the quality of the toner image transferred to transfer paper. The results showed that, even at the 100,000th repetition of image formation, every sample gave a high resolution, high quality image equal to the first image, thus demonstrating the excellent practical usefulness of the electrophotographic image-forming member of this invention.

TABLE 5

| Sample No. | Raw material gas | Carbon content in photoconductive layer (atomic %) | Image quality/ durability-summarized rating* |
|---|---|---|---|
| 14-1 | $SiH_4$, $C_2H_4$, Ar | 0.001 | Δ |
| 14-2 | " | 0.003 | Δ |
| 14-3 | " | 0.005 | ○ |
| 14-4 | " | 0.01 | ◎ |
| 14-5 | " | 0.1 | ◎ |
| 14-6 | " | 1.0 | ◎ |
| 14-7 | " | 5.0 | ◎ |
| 14-8 | " | 10 | ◎ |
| 14-9 | " | 15 | ○ |
| 14-10 | " | 20 | Δ |
| 14-11 | $SiH_4$, $Si_2H_2$, $C_2H_4$, Ar | 0.03 | ◎ |
| 14-12 | $Si_2H_6$, $C_2H_4$, Ar | " | ◎ |
| 14-13 | $SiF_4$, $SiH_4$, $C_2H_4$, Ar | " | ◎ |
| 14-14 | $SiH_4$, $B_2H_6$, $C_2H_4$, Ar | " | ◎ |
| 14-15 | $SiH_4$, $B_2H_6$, $CH_4$, Ar | " | ◎ |
| 14-16 | $SiF_4$, $SiH_4$, $B_2H_6$, $C_2H_4$, Ar | " | ◎ |
| 14-17 | $Si_2H_6$, $B_2H_6$, $C_2H_4$, Ar | " | ◎ |
| 14-18 | $SiH_4$, $Si_2H_6$, $B_2H_6$, $C_2H_4$, Ar | " | ◎ |
| 14-19 | $SiH_4$, $Si_2H_6$, $CO_2$, Ar | " | ◎ |
| 14-20 | $SiH_4$, $Si_2H_6$, $CH_4$, Ar | " | ◎ |
| 14-21 | $SiH_4$, $C_2H_8$, Ar | " | ◎ |
| 14-22 | $SiH_4$, $Si_2H_6$, $C_3H_8$, Ar | " | ◎ |

TABLE 5-continued

| Sample No. | Raw material gas | Carbon content in photoconductive layer (atomic %) | Image quality/ durability-summarized rating* |
|---|---|---|---|
| 14-23 | $SiH_4$, $SiF_4$, $C_3H_8$, Ar | " | ○ |

* ◎ Excellent;
○ Good;
Δ Sufficient for practical use

EXAMPLE 15

Using a substrate surface treated in the same manner as Example 3, an electrophotographic image-forming member was prepared in the same way as Example 13, and the image quality and durability thereof were evaluated, both giving good results.

EXAMPLE 16

Image-forming members were prepared in the same manner as Example 13 except that the thickness of coating layer on the substrate surface was varied by changing the anodic oxidation time, and were evaluated for image quality and repeatability, wherein the development was carried out by the magnetic brush development process, wherein such a development bias value was applied for each image-forming member as to give the best image. The results are shown in Table 6.

TABLE 6

| Thickness of coating layer (μ) | First image quality | Repeatability | Rating |
|---|---|---|---|
| 0.03 | X (Image density: low) | X (Ground fog soon developed) | X |
| 0.1 | Δ (Image density: somewhat low) | ○ (Ground fog developed in the negligible extent) | ○ |
| 0.5 | ○ (Image density: high) | ○ (Ground fog developed in the negligible extent) | ◎ |
| 2 | ○ (Image density: high) | ○ (Ground fog developed in the negligible extent) | ◎ |
| 5 | ○ (Image density: high) | Δ (Ground fog gradually developed) | ○ |
| 20 | ○ (Image density: high) | X (Ground fog soon developed) | X |

EXAMPLE 17

An electrophotographic image-forming member was prepared by the same procedures and under the same conditions as Example 5 except that $C_2H_4$ gas diluted to a concentration of 0.05 vol. % with $H_2$ [represented by "$C_2H_4(0.05)/H_2$"] was used in place of $NO_2$ gas. This image-forming member was tested by using the machine mentioned in Example 1, giving good results as to both image quality and repeatability,

EXAMPLE 18

An electrophotographic image-forming member was prepared by the same procedures and under the same conditions as Example 6 except that $CH_4$ gas was used in place of $NO_2$ gas. The image-forming member obtained was tested in the same manner as Example 1, with the result that an excellent image in resolution, gradation, and image density was obtained when corona charging at ⊖ 6 KV and development by a positive-charged developer were combined.

What we claim is:

1. A electrophotographic image-forming member comprising (1) a substrate for electrophotography which has a surface coating of an aluminum oxide containing water chemi-structurally and (2) a photoconductive layer which is laid on said substrate, and comprises an amorphous material containing at least one of hydrogen atom and halogen atom in a matrix of silicon atom, said photoconductive layer containing at least one of oxygen atom, nitrogen atom, and carbon atom.

2. An electrophotographic image-forming member according to claim 1, wherein said photoconductive layer contains oxygen atoms.

3. An electrophotographic image-forming member according to claim 2, wherein the oxygen atom content in said photoconductive layer is 0.005 to 20 atomic %.

4. An electrophotographic image-forming member according to claim 1, wherein said photoconductive layer contains nitrogen atoms.

5. An electrophotographic image-forming member according to claim 4, wherein the nitrogen atom content in said photoconductive layer is 0.01 to 20 atomic %.

6. An electrophotographic image-forming member according to claim 1, wherein said photoconductive layer contains carbon atoms.

7. An electrophotographic image-forming member according to claim 6, wherein the carbon atom content in said photoconductive layer is 0.001 to 20 atomic %.

8. An electrophotographic image-forming member according to claim 1, wherein said photoconductive layer contains oxygen atoms and nitrogen atoms.

9. An electrophotographic image-forming member according to claim 1, wherein said photoconductive layer contains oxygen atoms and carbon atoms.

10. An electrophotographic image-forming member according to claim 1, wherein said photoconductive layer contains nitrogen atoms and carbon atoms.

11. An electrophotographic image-forming member according to claim 1, wherein said photoconductive layer contains oxygen atoms, nitrogen atoms, and carbon atoms.

12. An electrophotographic image-forming member according to claim 1, wherein said amorphous material further contains germanium as a constituent atom.

13. An electrophotographic image-forming member according to claim 1, wherein said photoconductive layer is doped with a conductor type-determining impurity.

14. An electrophotographic image-forming member according to claim 13, wherein said impurity is an element belonging to the group III A of the periodic table.

15. An electrophotographic image-forming member according to claim 14, wherein said element belongs to the group III A of the periodic table is selected from B, Al, Ga, In, and Tl.

16. An electrophotographic image-forming member according to claim 14, wherein said impurity is contained in an amount of up to $3\times10^{-2}$ atomic %.

17. An electrophotographic image-forming member according to claim 13, wherein said impurity is an element belonging to the group V A of the periodic table.

18. An electrophotographic image-forming member according to claim 17, wherein said element belonging to the group V A of the periodic table is selected from N, P, As, Sb, and Bi.

19. An electrophotographic image-forming member according to claim 17, wherein said impurity is contained in an amount of up to $5\times10^{-3}$ atomic %.

20. An electrophotographic image-forming member according to claim 1, wherein hydrogen atoms are contained in an amount of 1 to 40 atomic %.

21. An electrophotographic image-forming member according to claim 1, wherein halogen atoms are contained in an amount of 1 to 40 atomic %.

22. An electrophotographic image-forming member according to claim 1, wherein the total content of hydrogen atom and halogen atom is 1 to 40 atomic %.

23. An electrophotographic image-forming member according to claim 1, wherein the thickness of said photoconductive layer is 1 to 100μ.

24. An electrophotographic image-forming member according to claim 1, wherein the thickness of said surface coating is 0.05 to 10μ.

* * * * *

UNITED STATES PATENT AND TRADEMARK OFFICE

CERTIFICATE OF CORRECTION

PATENT NO. : 4,461,820

DATED : July 24, 1984

INVENTOR(S) : SHIRAI, ET AL

It is certified that error appears in the above-identified patent and that said Letters Patent is hereby corrected as shown below:

Column 12, line 54, in line of Sample No. 2-12, change "$SiH_2,H_6,O_2,Ar$" to -- $Si_2H_6,O_2,Ar$ --

Column 17, line 57, in line of Sample No. 14-11, change "$SiH_4,Si_2H_2$" to -- $SiH_4,Si_2H_6$ --

Column 17, line 67, in line of Sample No. 14-21, change "$SiH_4,C_2H_8,Ar$" to -- $SiH_4,C_3H_8,Ar$ --

Column 18, line 6, change "O" to -- @ -- in "Image quality" column

Signed and Sealed this

*Twenty-eighth* Day of *May 1985*

[SEAL]

*Attest:*

DONALD J. QUIGG

*Attesting Officer* *Acting Commissioner of Patents and Trademarks*